US005145396A

United States Patent [19]

Yeung

[11] Patent Number: 5,145,396

[45] Date of Patent: Sep. 8, 1992

[54] COMBO SIMM CONNECTOR

[75] Inventor: Tak-Kin Yeung, City One, Hong Kong

[73] Assignee: Amphenol Corporation, Wallingford, Conn.

[21] Appl. No.: 791,164

[22] Filed: Nov. 13, 1991

[51] Int. Cl.[5] ..... H01R 13/62

[52] U.S. Cl. ..... 439/326

[58] Field of Search ..... 439/296, 326–328, 439/629–637

[56] References Cited

U.S. PATENT DOCUMENTS 4,986,765 1/1991 Korsunsky et al. ..... 439/326
4,995,825 2/1991 Korsunsky et al. ..... 439/326
5,002,498 3/1991 Takahashi ..... 439/326
5,004,429 4/1991 Yagi et al. ..... 439/326

*Primary Examiner*—Joseph H. McGlynn
*Attorney, Agent, or Firm*—Bacon & Thomas

[57] ABSTRACT

A SIMM-type connector for electrically connecting contact surfaces on a daughter board with contact areas on a printed circuit board, and for releasably supporting the daughter board edgewise in respect to the printed circuit board, includes an improved latching mechanism wherein a plastic board latching projection and projection supporting post are molded into the main body of the connector, and wherein a metal reinforcing clip is fitted over latching projection to provide advantages of resilience and resistance to setting without the necessity for complicated metal forming operations.

12 Claims, 4 Drawing Sheets

COMBO SIMM CONNECTOR

BACKGROUND OF THE INVENTION

1. Field of the Invention

The present invention relates to the field of single in-line memory module (SIMM) connectors, and in particular to an improved memory module latching mechanism for a SIMM connector. More generally, the invention relates to latching mechanisms for removably attaching circuit cards or "daughter" boards to a mother board or other printed circuit device.

2. Description of Related Art

The SIMM connector is a connector which permits edgewise mounting of a memory chip circuit module onto a printed circuit board, and provides an electrical connection between contact surfaces of the "daughter" or "baby" board which carries the memory chips and contact areas of the printed circuit board, or "mother" board. Since their introduction only a few years ago, SIMM connectors have attained widespread acceptance for use in computers of all types, including personal computers, workstations, and mainframes. Reasons for their popularity include the fact that the edgewise mounting arrangement made possible by the SIMM connector sharply reduces the space occupied by a memory module on the mother board. Also, because of the releasable latch mechanism developed for the SIMM connector, SIMM technology permits field replacement of not only the connectors themselves, but also of individual memory modules. This later feature has made it possible to easily upgrade to higher density RAMs as they became available, the circuitry changes being made on the module rather than on the mother board. In addition, although at present generally used for memory chips, SIMM technology can also be used to facilitate installation and replacement of custom manufactured integrated circuit chips, a possibility that offers virtually unlimited opportunity for continued expansion of the technology in the near future.

Several versions of the SIMM connector are currently being manufactured, but each includes a plurality of contacts which extend from a first mating surface of the connector to a second mating surface. The contacts have posts which extend from the first mating surface and are arranged to electrically engage the contact areas of the mother board when the connector is plugged into or otherwise secured thereto. The daughter board is inserted into a groove in the second mating surface of the connector and rotated to its operating position. As this rotation occurs, contact projections of the contacts engage the contact surfaces of the daughter board. In order for this electrical engagement to be maintained, latch arms are provided to cooperate and securely but releasably maintain the daughter board in the operational position.

Examples of this type of electrical connector are described in U.S. Pat. Nos. 4,737,120 and 4,850,892. In each example, the latch members are provided at the ends of the connector, and are integrally molded with the housing. This configuration of the latch members provides the latch members with the resilience characteristics required in order to allow the latch members to cooperate with the daughter board or SIMM to maintain the daughter board in electrical engagement with the terminals of the connector.

Although representing a clear improvement over other board mounting arrangements, however, several problems are associated with the latch configuration described above. Because the latch members are molded from plastic material, and because the resilience characteristics of plastic are less than those of metal, conventional plastic latches are likely to take a permanent seat, particularly when the connector is use dover many SIMM insertion and removal cycles. This likelihood is increased due to that the fact the latch members must have a relatively thin width when molded. This requirement reduces the durability of the latch members and, consequently, if the electrical connector is to be used over many cycles, the risk of failure of the electrical connector is great.

The problem is exacerbated by the fact that the daughter boards often vary in size while still falling within tolerance limits for the connector. Thus it is possible that a relatively large board will be inserted into the groove or slots in the second mating surface, and then be followed by a relatively small board. The insertion of the large board into the groove can cause the plastic latch to take a permanent set or weaken, so that when the smaller board is inserted, the latch will not be as effective in maintaining the board in the slot, resulting in an ineffective connector.

One proposed solution to these problems is disclosed in U.S. Pat. No. 4,986,765. As described in this patent, the proposed solution is to construct the latch metal as a discrete member which replaces the prior molded-in latch and is mounted in a latch-receiving recess provided in the connector. The latch includes a resilient section for latching the SIMM or daughter board and a mounting section which extends from the base of the resilient section and is dimensioned to extend through the recess and be received in an aperture of the mother board.

In order to provide a stable attachment of the latch to the SIMM connector and mother board, since the metal latch is not integrally molded in, a relatively complex latch mounting arrangement is used. The latching mounting structure includes a U-shaped portion, one arm of which engages a wall of the recess in a stressed condition to secure the latch in position. In addition to requiring a special mounting section, the metal latch design requires separate shaping of the latching projection which permits the board to be rotated into place and subsequently secured. Thus, the all metal design, while solving the problems of weakness and lack of resilience inherent in the molded-in all-plastic design, results in greatly increased complexity and manufacturing costs.

In overcoming the problems of the all-plastic design, the metal latch design therefore loses the manufacturing and cost advantages provided by forming the SIMM connector, including the latch arms, in a single mold, and of necessity adds a complex mounting section and latching projection section which are sources of both manufacturing difficulties and potential failure during use.

In view of the above problems, it would be desirable to provide a latch for a SIMM-type connector which is simpler in design than the metal latch, and yet which is more resilient and less subject to setting during repeated use cycles than is the all-plastic design.

SUMMARY OF THE INVENTION

The invention seeks to provide an improved design in which each of the disadvantages of prior designs is overcome by providing a latching member for a SIMM connector which is more resilient and resistant to setting than all-plastic molded-in latch designs, and yet which is relatively simple to manufacture and assembly in comparison with all-metal latch designs.

More generally, the invention seeks to provide an improved latch design for a variety of connectors which provide an electrical connection between contact surfaces of a daughter board and contact areas of a mother board.

According to a still further objective, the invention seeks to provide a method of assembling an electrical connector for electrically connecting contact surfaces of a daughter board, in particular a SIMM, and contact areas of a mother board using an improved latch design which greatly increases the durability of previous all plastic designs without significantly complicating the manufacturing process.

These objectives are accomplished in accordance with a preferred embodiment of the invention by providing a hybrid metal and plastic latch for use in any edge mount or SIMM-type connector. Resilience and resistance to setting are provided by a metal plate which is supported by a molded-in plastic post rather than by a formed metal mounting section, the post including an integral molded-in latching projection. This inventive concept of a metal reinforced plastic latching member may be used in a variety of contexts in which it is advantageous to provide molded-in features while also requiring reinforcement best provided by a metal member. Furthermore, in accordance with a preferred method of assembling a SIMM-type connector, the latching structure is molded into the connector and the metal reinforcing member is simply fitted over the molded-in latching member.

DETAILED DESCRIPTION OF THE PREFERRED EMBODIMENTS

Figure 1:
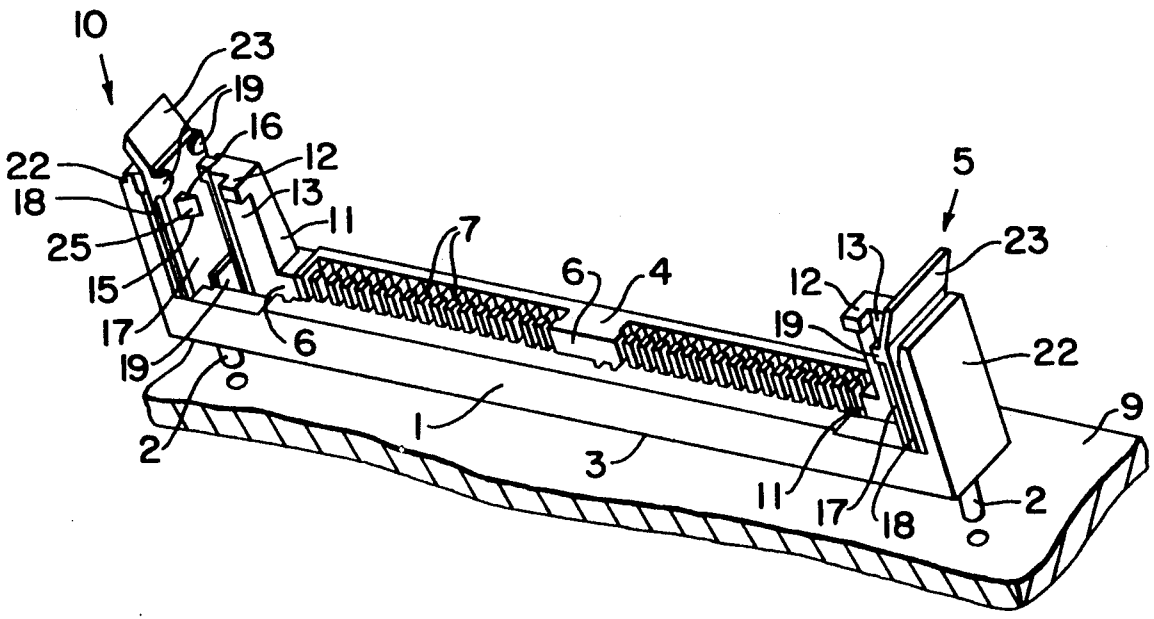
FIG. 1 is a perspective view of a SIMM connector including an improved SIMM latching mechanism in accordance with a preferred embodiment of the invention.
Figure 2:
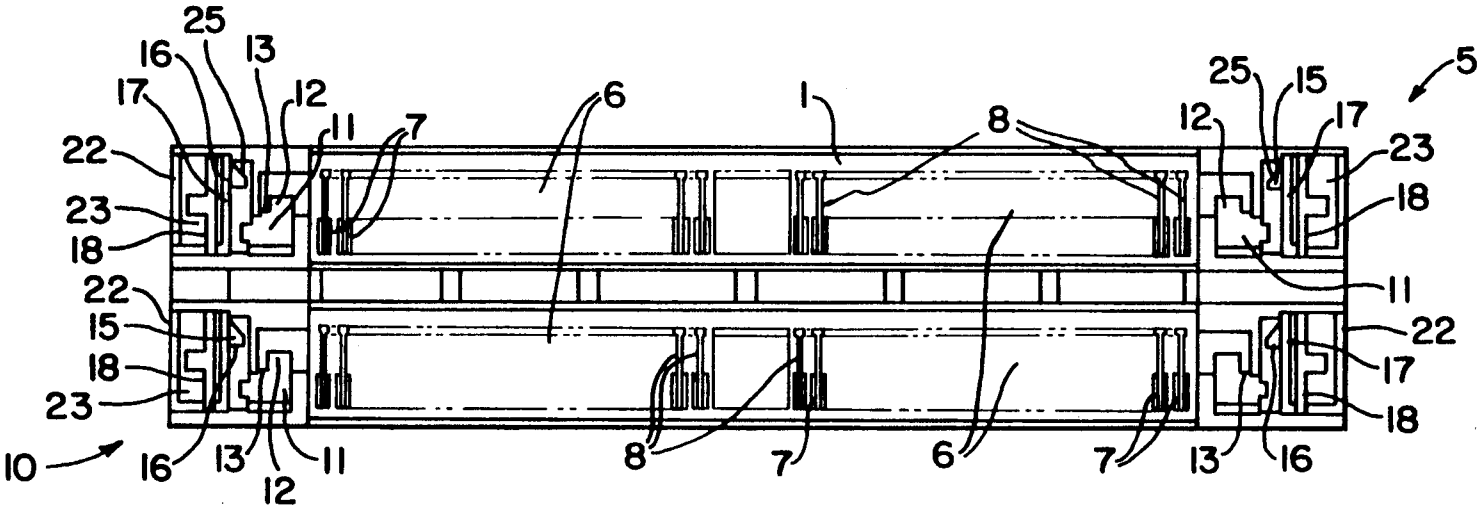
FIG. 2 is an elevated top view of a second SIMM connector which also includes the improved SIMM latching mechanism of the preferred embodiment of the invention.
Figure 3:
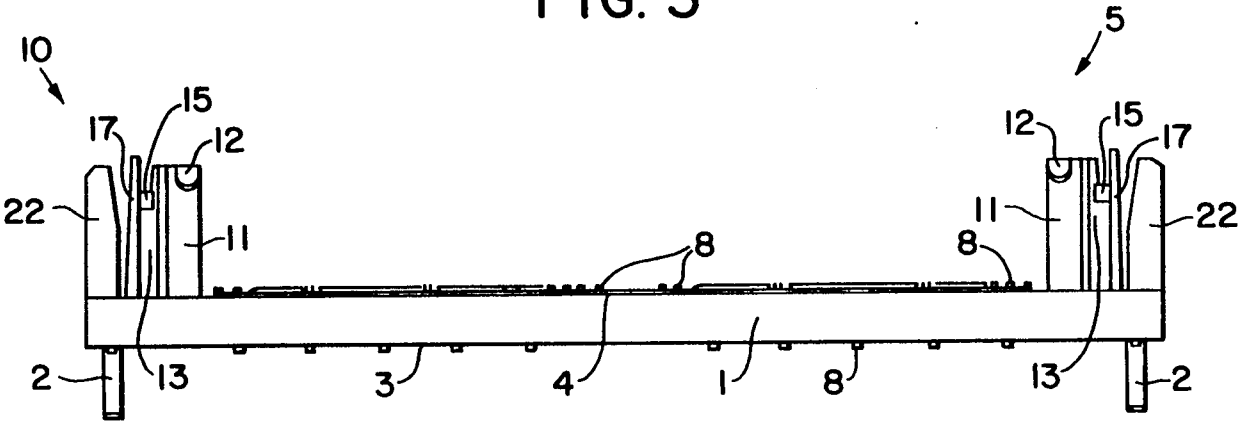
FIG. 3 is an elevated side view of the preferred SIMM connector of FIG. 2, with reinforcing members removed.

As illustrated in FIGS. 1-3, the preferred SIMM connector includes a main body portion 1 which is mounted to a printed circuit board or mother board 9 by posts 2 extending from a first surface 3 of the main body portion 1. Provided in the opposite or second surface 4 of the main body is a groove 6 for receiving the daughter board or SIMM (not shown). Groove 6 includes a plurality of transversely arranged slots 7 for receiving contacts 8 which extend through the main body portion 1 to engage contact areas on the mother board 9, and which are arranged to also engage contact surfaces of the daughter board when the daughter board is fitted into groove 6 and latched in the manner to be described below. This arrangement of the contacts, slots, grooves, and mounting posts is conventional and forms no part of the present invention. In particular, numerous different contact designs are known to those skilled in the art, any of which may be used.

Figure 4:
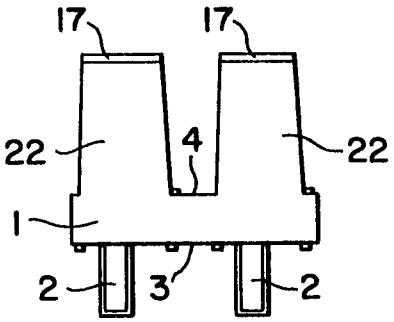
FIG. 4 is an elevated end view of the preferred SIMM connector of FIG. 2.

As shown in FIG. 2, the preferred SIMM connector may have a plurality of grooves 6, each associated with a corresponding latching section and contacts. Latching sections 5 on one side of the connector are identical to each other and mirror symmetric with latching sections 10 on the opposite side of the connector. Of course, those skilled in the art will appreciate that the number of grooves, and therefore the number of boards which may be accommodated by the SIMM connector, is not limited to one as shown in FIG. 1 or two as shown in FIGS. 2-4.

Extending from main body portion 1 are SIMM alignment posts 11 or conventional construction from which extend projections 12 positioned to extend through apertures in the SIMM when the SIMM is rotated into position. Surface 13 on posts 11 support the board in a vertical position, although it will be appreciated that the SIMM connector may be designed so that the boards are placed at an angle rather than vertically. Also daughter boards other than SIMMs need not include a hole designed to accommodate projection 12, and therefore projection 12 is optional.

The preferred SIMM connector may include a conventional orientating projection or key (not shown) on one side of main body portion 1. Because the orientation of the daughter board is crucial in cases where circuits on the board are not completely symmetric, a cut-out is provided on the board which fits over the key when the board is properly oriented, and prevents insertion of the board when it is not properly oriented.

As noted previously all of the above elements are conventionally provided in the form of a single molded plastic member for ease of manufacture, although it is possible that the alignment posts, key, and other elements, may be made of a different material and still fall within the scope of the invention, as described below.

The invention lies in an improved latching mechanism as follows:

In order to latch the daughter board in position against surface 13, a latching projection 15 supported by and molded into plastic latch member 17 is provided. The board is latched between surface 16 of latching projection 15 and surface 13 of the alignment post 11 when the daughter board is rotated into position after being inserted into groove 6. In order for latching to occur, latch member 17 must flex outwardly in the longitudinal direction of the main body to permit the edge of the SIMM to pass projection 15.

Projection 15 includes a camming surface 25 which intersects surface 16 at an acute angle to cause latch member 17 to flex outwardly in response to movement of the board thereagainst during insertion. Removal of the board is accomplished by manually causing the latch to flex outwardly a distance sufficient to cause the projection to clear the edge of the board.

After the edge of the SIMM has passed latching projection 15 during insertion, latch member 17 should return to its original unstressed position, thereby holding the daughter board between surfaces 13 and 16. As noted in the introductory portion of this description, however, the molded-in plastic of the latch member 17 by itself may be subject to structural failure, and especially to setting, during repeated use cycles of the connector. Therefore, the improved latch mechanism includes a metal clip or reinforcing member 18 formed from a metal plate which clips over latch member 17. Member 18 reinforces and provides added resilient to latch member 17, but the manner of operating the latch member is otherwise unchanged. One suitable material for member 18 is stainless steel, although numerous other metals such as beryllium copper or phosphor bronze may be substituted.

Figure 6:
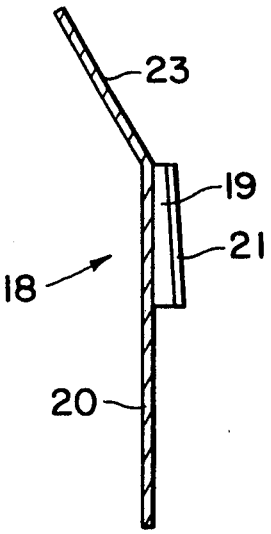
FIG. 6 is a cross-sectional side view of the reinforcing member shown in FIG. 5.
Figure 5:
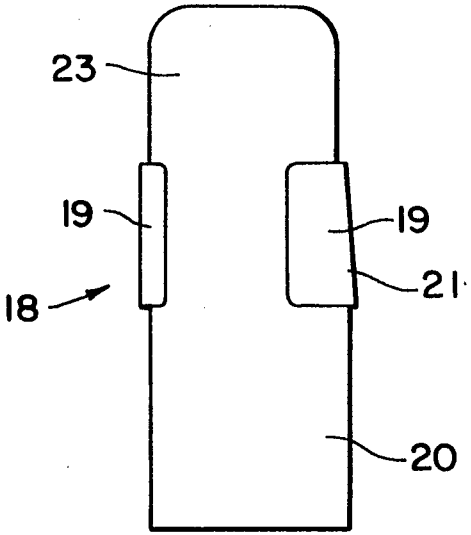
FIG. 5 is a plan view of a reinforcing member for use in the preferred connector of FIG. 1.

As shown in FIGS. 5 and 6, the reinforcing member 18 includes retention sections 19 in the form of bent metal extensions which fit over the molded-in plastic latching member to secure the clip in place by engaging a surface of the latching ember which is opposite the surface engaged by the main body 20 of the reinforcing member, from which retention sections 19 extend. However, it will be appreciated by those skilled in the art that structures other than retention sections 19 as illustrated may be used to retain metal reinforcing member 18 on plastic latch member 17. For example, the retention sections need not be essentially rectangular as shown, nor need they be asymmetric. The illustrated flared section 21, which facilitates fitting of member 18 onto member 17 may either be omitted entirely or included on both sides of the reinforcing member. Alternatively, member 18 may be secured to member 17 insert molding or by a suitable adhesive, although the use of bent extensions provides the advantage that the clip 18 is removable.

The connector is completed by providing molded-in plastic support members 22 at ends of the connectors to further prevent the latch from damage due to flexing too far during removal of the daughter board. In addition, an extension 23 on a reinforcing member 18 may be provided to facilitate manual unlatching of the daughter boards by causing latching member 17 to flex away from the board until surface 16 disengages and the board is free to rotate away from alignment posts 11.

In comparison with an all-metal latch manufacturing process, the improved manufacturing process for the latching mechanism of the preferred invention simply involves molding the latch member 17, including latching projection 15, simultaneously with molding of the main body portion 1, mounting posts 2, alignment posts 11, and key 14, and subsequently fitting reinforcing member 18 over latch member 17.

The reinforcing member itself, including retention sections 19 and unlatching extension 23, may be formed form a single rectangular piece of metal stamped to include extensions which are subsequently bent to obtain retention sections 19 for retaining the reinforcing member on latch member 17. Because member 18 merely reinforces member 17 and does not engage the daughter board, tolerances in forming this element may be much greater than is the case for an all-metal latching member.

Having thus described a specific example of the invention in terms of a hybrid composite latch for a SIMM connector, it will nevertheless be appreciated by those skilled in the art that the principles of the invention, i.e., the use of molded-in latching members with a metal clip for reinforcement, is not limited to SIMM connector designs, but rather may have application in a variety of similar card connectors requiring similar latches. Therefore, it is intended that the invention not be limited to the specific embodiment described above, but rather that it be limited solely by the appended claims.

I claim:

1. In a connector of the type including a molded plastic main body portion, a groove in the main body portion for receiving a daughter board, means for electrically connecting contact surfaces on the daughter board with contact areas on a printed circuit board, means for mounting the main body portion on the printed circuit board, an alignment post for supporting one surface of the daughter board, and a latching mechanism including a latching member and a latching projection extending from the latching member for engaging an opposite surface of the daughter board to secure the daughter board between the alignment surface and the latching projection, wherein the latching member is flexed outwardly to permit the daughter board to pass the latching projection during removal of the daughter board from the connector and during insertion of the daughter board into the connector, the improvement wherein:

the latching member and latching projection are integrally molded with the plastic main body portion of the connector, and wherein the latching mechanism further includes a metal reinforcing member secured to the latching member to provide reinforcement and increased resilience for the latching member.

2. A connector as claimed in claim 1, wherein said reinforcing member is secured to the latching member by means of retention sections which comprise integral extensions of said reinforcing member, bent to fit over the latching member and to engage a surface of the latching member opposite a surface engaged by a main body of the reinforcing member, for removably retaining the reinforcing member on the latching member.

3. A connector as claimed in claim 1, wherein said connector is a SIMM connector.

4. A composite latching mechanism suitable for use in a SIMM connector, comprising a plastic latch member, means including an integral projection extending form the plastic latching mechanism and engaging a surface of a daughter board to be latched between the projection and a surface of an alignment member, and means including a metal reinforcing member secured to said latching member for reinforcing said latching member as it flexes to permit a board to pass said projection during insertion of the board into the connector or removal of the board from the connector.

5. A latching mechanism as claimed in claim 4, wherein said reinforcing member is secured to the latching member by means of retention sections which comprise integral extensions of said reinforcing member, bent to fit over the latching member and to engage a surface of the latching member opposite a surface engaged by a main body of the reinforcing member, for removably retaining the reinforcing member on the latching member.

6. A metal clip for reinforcing a SIMM connector latching mechanism, comprising a metal plate and means including extensions integral with the metal plate which form a passage for receiving a plastic latch member, said latch member including means comprising a latching projection molded into the latch member for engaging a circuit component carrying board to latch said board against an alignment post.

7. A connector as claimed in claim 6, further comprising means including flaring on one of said extensions for facilitating fitting of said metal plate over said plastic latch member.

8. A method of manufacturing a connector, comprising the steps of:

molding of plastic, in a single mold, a connector main body portion including a groove for receiving a daughter board edgewise therein, and a latching projection supported by a latch member extending from the main body for latching the daughter board by engagement with the latching projection after the latching member has flexed to permit the daughter board to pass the latching projection during insertion of the daughter board into the connector; and fitting a metal reinforcing clip over the latching member.

9. A method as claimed in claim 8, wherein said step of molding comprises the step of molding together with the connector main body portion, latching member, and latching projection, an alignment post including means defining an alignment surface for engaging a surface of the daughter board opposite a surface engaged by the latching projection when said daughter board is inserted into said connector.

10. A method as claimed in claim 8, wherein said step of molding further comprises the step of forming means including slots in said main portion for receiving SIMM contacts, said SIMM contacts engaging contact surfaces on the daughter board when the daughter board is inserted into the connector and corresponding contact surfaces of a printed circuit board to which the connector is to be mounted.

11. A method as claimed in claim 8, further comprising the step of forming the reinforcing clip by stamping it form a blank to include integral retention sections for engaging the latch member to secure the reinforcing clip on the latch member.

12. A method as claimed in claim 11, wherein the step of forming said retention sections comprises the steps of forming a main body of said reinforcing clip and extensions of said main body, and bending the extensions to engage a side of the latch member which is opposite a side of the latch member engaged by the main body when said reinforcing clip is fitted over the latch member.

* * * * *